US006410892B1

(12) United States Patent
Peschl et al.

(10) Patent No.: US 6,410,892 B1
(45) Date of Patent: Jun. 25, 2002

(54) COOKTOP HAVING A FLAT GLASS CERAMIC COOKING SURFACE

(75) Inventors: Franz Peschl; Nils Platt; Ray Callahan; Bernd Hopfenmueller, all of New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 09/884,372

(22) Filed: Jun. 19, 2001

(51) Int. Cl.[7] ..... H05B 3/68; F24C 15/10

(52) U.S. Cl. ..... 219/461.1; 219/412.11; 126/218

(58) Field of Search ..... 219/450.1, 451.1, 219/452.11, 452.12, 460.1, 461.1, 462.1; 126/39 N, 39 J, 90 A, 92 AC, 92 A, 211, 217, 218

(56) References Cited

U.S. PATENT DOCUMENTS

| | | | | | |
|---|---|---|---|---|---|
| 3,586,825 | A | * | 6/1971 | Hurley | 219/452.12 |
| 3,627,986 | A | * | 12/1971 | Anderson | 219/452.12 |
| 3,632,983 | A | * | 1/1972 | Dills | 219/452.12 |
| 3,870,862 | A | * | 3/1975 | Doner | 219/452.12 |
| 3,927,658 | A | | 12/1975 | Olthuis | |
| 4,264,805 | A | * | 4/1981 | Traut | 219/452.12 |
| 4,492,217 | A | | 1/1985 | Scheidler | |
| 5,185,047 | A | | 2/1993 | Ray | |
| 5,227,610 | A | | 7/1993 | Schultheis et al. | |
| 5,317,129 | A | | 5/1994 | Taplan et al. | |
| 5,399,839 | A | | 3/1995 | Taplan et al. | |
| 5,429,114 | A | | 7/1995 | Taplan et al. | |
| 5,530,224 | A | * | 6/1996 | Sassman | 219/452.12 |
| 5,568,804 | A | * | 10/1996 | Joseph et al. | 126/39 K |
| 5,571,434 | A | * | 11/1996 | Cavener et al. | 219/452.12 |
| 5,653,219 | A | | 8/1997 | Taplan et al. | |
| 5,679,273 | A | | 10/1997 | Petetin | |
| 5,813,395 | A | | 9/1998 | Taplan et al. | |
| 5,841,109 | A | | 11/1998 | White et al. | |
| 5,844,206 | A | * | 12/1998 | Steiner et al. | 219/452.12 |
| 5,847,364 | A | | 12/1998 | White et al. | |
| 5,893,359 | A | | 4/1999 | Schultheis et al. | |
| 5,900,175 | A | | 5/1999 | Kicherer et al. | |
| 5,990,457 | A | | 11/1999 | Steiner et al. | |
| 6,002,112 | A | | 12/1999 | Nass et al. | |
| 6,043,462 | A | * | 3/2000 | Stedron et al. | 219/452.11 |
| 6,111,229 | A | | 8/2000 | Schultheis | |
| 6,148,812 | A | | 11/2000 | Taplan et al. | |
| 6,027,933 | A1 | * | 3/2001 | Stedron et al. | 219/452.11 |
| 6,207,933 | B1 | | 3/2001 | Stedron et al. | |
| 6,274,849 | B1 | * | 8/2001 | Paybarah | 219/461.1 |

* cited by examiner

*Primary Examiner*—Sang Paik
(74) *Attorney, Agent, or Firm*—Brooks & Kushman P.C

(57) ABSTRACT

A cooktop having a flat glass ceramic plate and a plurality of rails independently attached to the bottom surface of the glass ceramic plate. The rails are configured to be received in a cutout in a countertop and are not connected to each other at the corners. The bottom of the cooktop is enclosed by a rough in-box consisting of a primary U-shaped cover and two independent end covers.

20 Claims, 5 Drawing Sheets

COOKTOP HAVING A FLAT GLASS CERAMIC COOKING SURFACE

BACKGROUND OF THE INVENTION

1. Field of the Invention

The invention is related to cooktops having flat glass ceramic surfaces.

2. Background Art

Cooktops having flat glass ceramic plates for the cooking surface on which pots, pans or other cooking utensils are placed to be heated are well known in the art. The flat glass ceramic surface has many advantages. They provide a unitary surface which is aesthetically pleasing to the eye. Further, the ceramic glass cooktop greatly enhances the ease with which the cooktop may be cleaned and they do not require a precise positioning of the pot or pan to be heated. On the other hand, the glass ceramic cooktops have the disadvantage that they are more fragile than metal cooktop surfaces and are more subject to mechanical and thermal stress than cooktops made of metal.

Various means have been used to mount glass ceramic cooktops in a cutout or receptacle provided in a kitchen countertop. For example, Steiner et al in U.S. Pat. No. 5,844,206 teaches the use of a plastic frame injection molded about the periphery of the glass ceramic plate. This plastic frame supports the cooktop in the countertop recess. The frame includes an outwardly extending flange which engages the countertop about the edges of the recess. Alternatively, Stedron et al in U.S. Pat. No. 6,207,933 teaches the use of a metal frame circumscribing the periphery of the glass ceramic plate. Stedron et al's frame also includes an outwardly extending flange outside the perimeter of the glass ceramic plate. A reactive adhesive foam is used to bond the glass ceramic plate to the metal frame.

Alternatively, Stedron et al in U.S. Pat. No. 6,043,462 discloses a metal frame attached to the back side of the glass ceramic plate and has an outwardly extending flange underlying the glass ceramic plate adjacent to its periphery.

The invention is a multi-piece frame attached to the bottom surface of the glass ceramic plate which is more flexible and induces less stress on the glass ceramic plate.

SUMMARY OF THE INVENTION

A cooktop receivable in a cutout of a countertop having a glass ceramic plate sized to completely cover the cutout. Front, rear and side rails are independently attached to the bottom surface of the glass ceramic plate. The front, rear, and side rails have at least a U-shaped portion and an outwardly extending flange extending to a region overlapping the edges of the cutout. A plurality of heating elements are supported against the bottom surface of the glass ceramic plate from the front, rear and side rails plus a control box containing the electronic controls providing electrical power to the heating elements. The back side of the cooktop is enclosed by a three-piece rough in-box consisting of a U-shaped primary cover connected to the opposing rails and two side covers enclosing the open ends of the primary cover, the side covers being attached to the side rails.

One object of the invention is a cooktop having a glass ceramic plate capable of sustaining without damage the U.L. drop test.

Another object of the invention is a cooktop having front, rear and side rails independently attached to the glass ceramic plate. The ends of the front, rear and side rails are not connected at the corners to reduce the stress in the glass ceramic plate.

Another object of the invention is to provide the front, rear and side rails with outwardly extending flanges which overlap the edges of the cutout of the countertop. The outwardly extending flanges being maintained within the periphery of the glass ceramic plate.

Still another object is to provide detents on the outwardly extending flanges extending away from the glass ceramic plate to minimize the thermal contact area between the outwardly extending flanges and the countertop.

Another object is to provide a recess in the outwardly extending flanges between the detents to reduce heat flow to the countertop.

Another object of the invention is to provide a slot between each detent and the U-shaped portion of the front rear and side rails to minimize heat flow to the countertop.

Still another object of the invention is to attach insulating pads to the outwardly extending flanges on the side opposite the glass ceramic plate to minimize heat flow to the countertop.

Still another object of the invention is to provide at least one crossbar connected between the front and rear rails to help support at least one heating element.

Another object is to attach springs to the crossbar resiliently biasing the heating element against the bottom surface of the glass ceramic plate.

Another object is to reduce the thermal contact between the crossbar and the front and rear rails to which it is attached.

Yet another object is to provide thermal insulating pads between the crossbar and the rails to which it is attached.

A final object of the invention is to provide a three-piece rough-in-box to minimize stresses on the glass ceramic plate.

These and other objects will become more apparent from a reading of the specification in conjunction with the drawings.

DETAILED DESCRIPTION OF THE PREFERRED EMBODIMENT(S)

Figure 1:
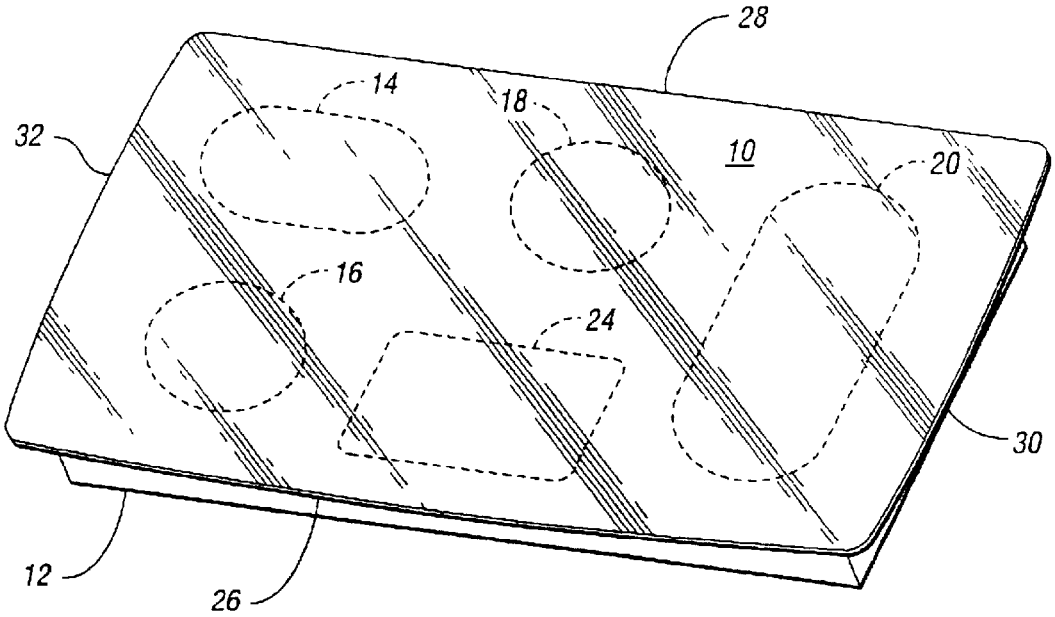
FIG. 1 is a perspective view showing the top side of the cooktop.

FIG. 1 is a perspective view of a cooktop receivable in a cut-out or recess provided in a kitchen counter. The cooktop consists of a glass ceramic plate to which is fastened a support structure 12 which supports a plurality of heating elements 14–20 and a control box 24 containing a set of control elements below the glass ceramic plate 10. The control elements in the control box 24 control the application of electrical power to the individual heating elements 14–20. The front peripheral edge 26, the rear peripheral edge 28 as well as the left peripheral edge 30 and the right peripheral edge 32 of the glass ceramic plate 10 extend over the countertop.

Figure 2:
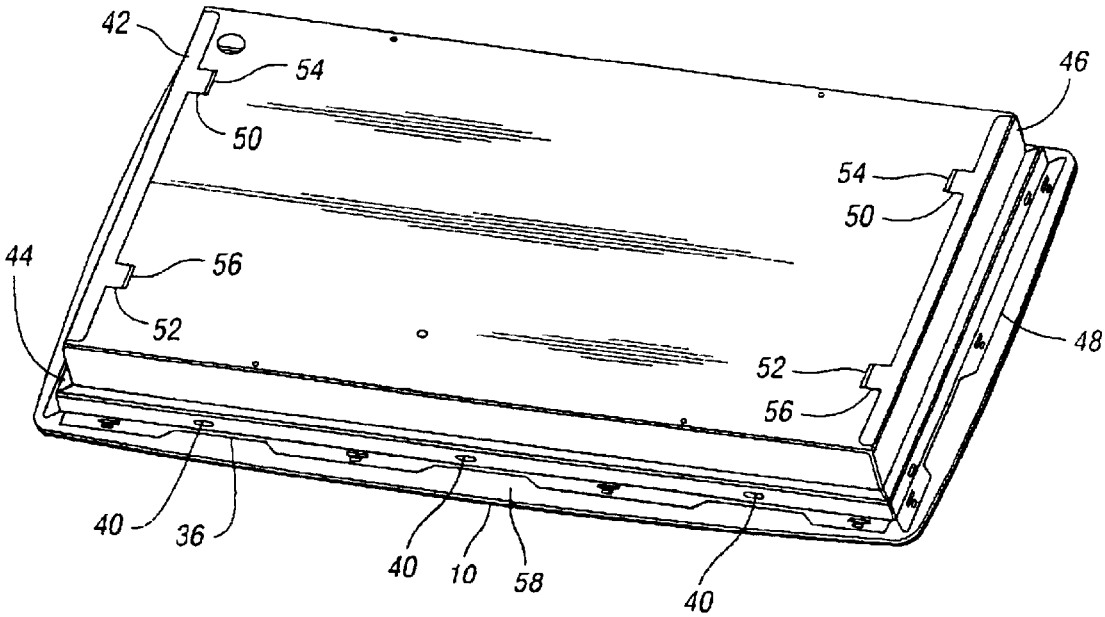
FIG. 2 is a perspective view showing the bottom side of the cooktop.

FIG. 2 is a bottom view of the cooktop. The heating elements 14–20 and the control box 24 are enclosed by a rough-in-box primary cover 34 attached to a front rail 36 and a rear rail 38 (not shown) by a set of fasteners 40, such as screws. Rough-in-box end covers 42 and 46 complete the rough-in-box and are attached to side rails 44 and 48.

The end covers 42 and 46 enclose the opposite ends of the primary cover 34 as shown. The end covers 42 and 46 may have one or more tabs, such as tabs 50 and 52 which are received in slots 54 and 56 respectively provided in the primary cover 34. These tabs 50 and 52 loosely attach the end covers 42 and 46 to the primary cover 34 at the bottom. The end covers 42 and 46 are fixedly attached to side rails 44 and 48 respectively by fasteners such as screws (not shown). Alternatively, the primary cover 34 may be connected between the side rails and the end covers 42 and 46 may be attached to the front and rear rails respectively.

The front rail 36, rear rail 38 and side rails 44 and 48 are independently attached to the rear surface 58 of the glass ceramic plate 10 using an appropriate adhesive to form a rectangular frame. The ends of the side rails 44 and 48 are not physically joined or attached to the ends of the front and rear rails 36 and 38 respectively. This independent attachment of the side, rear and front rails to the glass ceramic plate significantly reduces the stresses induced in the glass ceramic plate 10. Using this structural arrangement, the glass ceramic plate 16 retains its ability to flex. This feature permits the cooktop to pass the Underwriters Laboratories (U.L.)-dropped weight test in which a prescribed weight is dropped from a predetermined height onto the glass ceramic plate without the glass ceramic plate sustaining damage.

Figure 3:
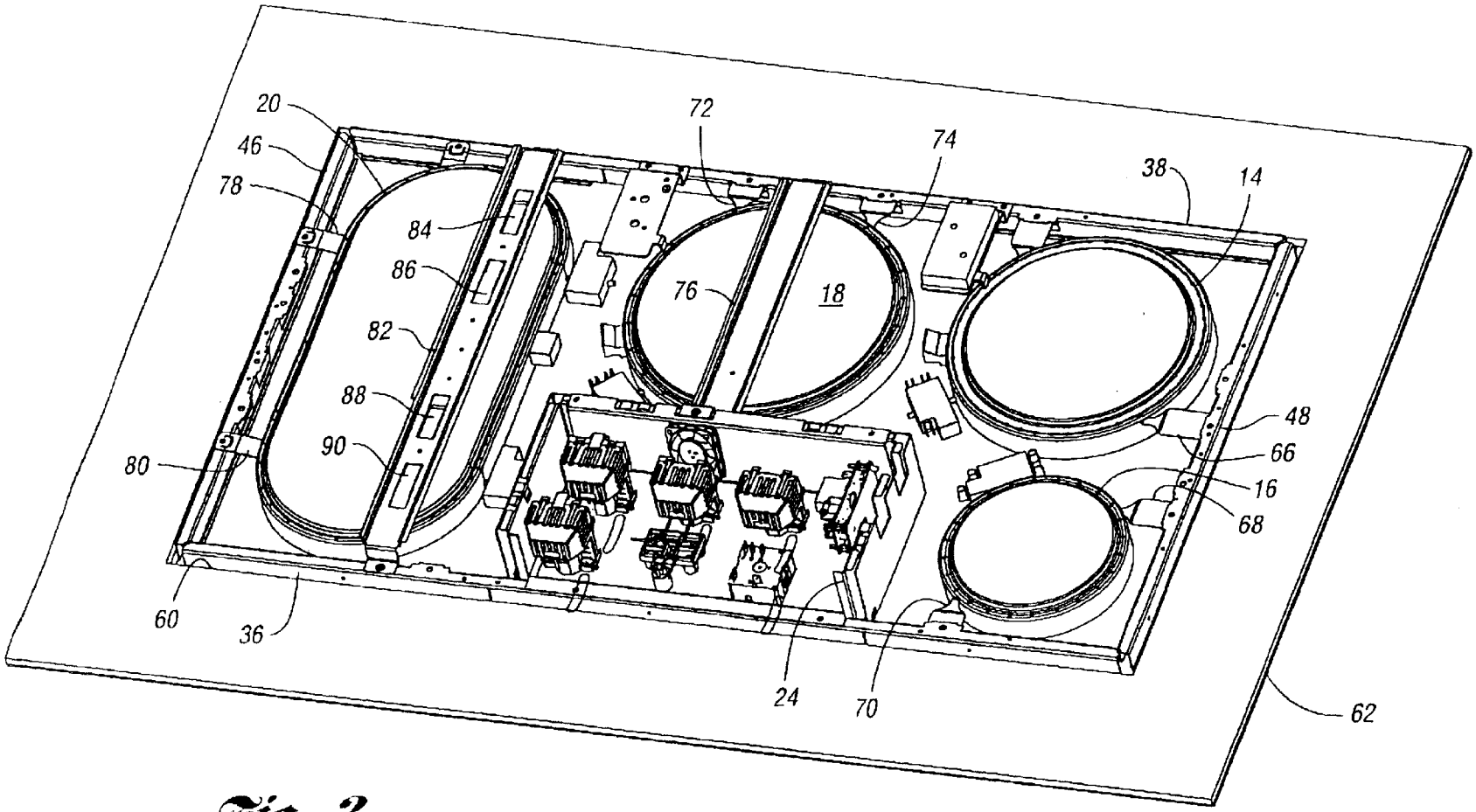
FIG. 3 is a perspective view showing the bottom side of the cooktop with the rough-in-box removed.
Figure 10:
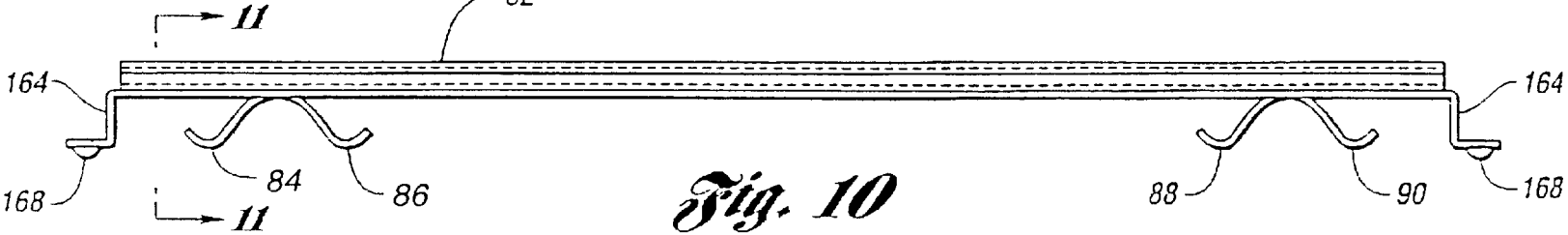
FIG. 10 is a top view of the long crossbar.
Figure 12:
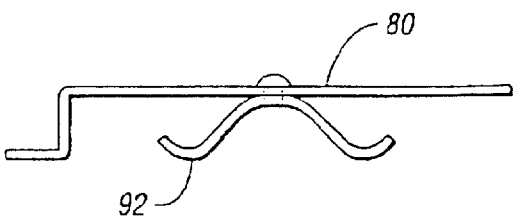
FIG. 12 is a partial side view of an alternate embodiment of the long crossbar.
Figure 11:
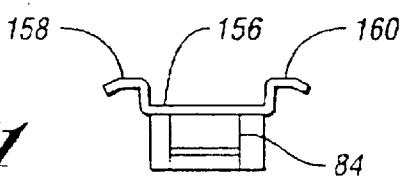
FIG. 11 is an end view of the long crossbar.

FIG. 3 is a perspective of the underside of the cooktop with the primary cover 34 and end covers 42 and 46 removed. In FIG. 3, the cooktop is shown received in a rectangular cutout 60 in a countertop 62. As shown, the front rail 36, rear rail 38 and side rails 44 and 48 are arranged in the form of a rectangle that is receivable within the countertop cutout 60. The heater element 14 is supported against the glass ceramic plate 10 by tabs 64 and 66 attached to the rear rail 38 and side rail 48 respectively. Heater element 16 is supported against the glass ceramic plate 10 by tabs 68 and 70 attached to the front rail 36 and side rail 48 respectively. Heating element 18 is held by tabs 72 and 74 attached to the rear rail 38 and a short crossbar 76 attached between the rear rail 38 and the control box 24. Finally, the heating element 20 is held in place by mounting tabs 78 and 80 attached to side rail 42 and by long crossbar 82. The long crossbar 82 has a plurality of leaf springs 84, 86, 88 and 90 which bias the heating element 20 against the rear surface 58 of the glass ceramic plate 10. These leaf springs 84–90 may be formed directly as punched-out portions of the long crossbar as shown in FIGS. 10 and 11 or the leaf springs may be separate elements such as a leaf spring 92 and attached to the long crossbar 82 by a screw or rivet as shown in FIG. 12.

Figure 4:
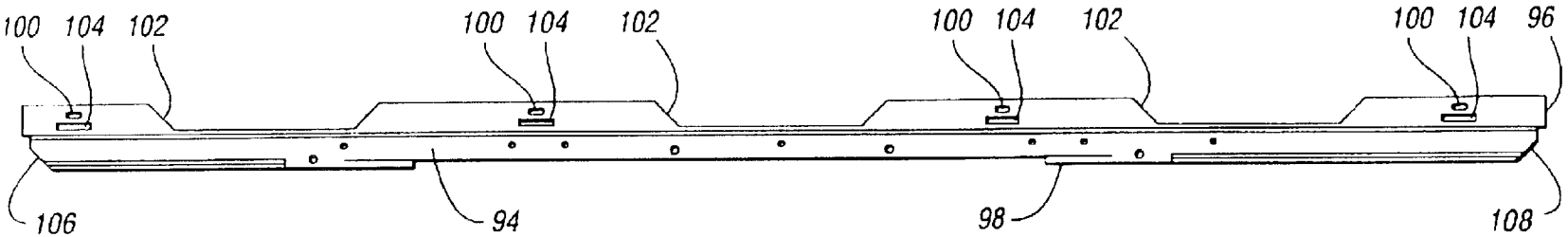
FIG. 4 is a top view of the front and rear rails.
Figure 5:
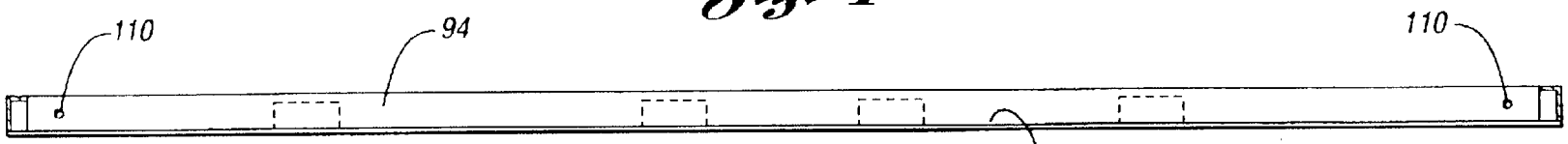
FIG. 5 is a side view of the front and rear rails.
Figure 6:
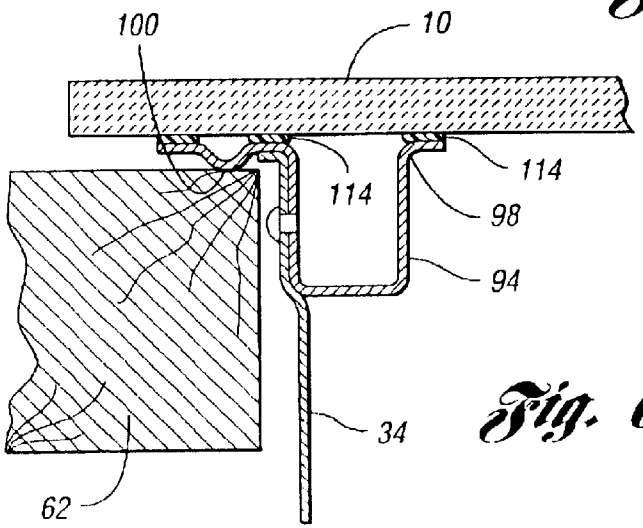
FIG. 6 is an end view of the front and rear rails.

The details of the front rail 36 and rear rail 38 are shown on FIGS. 4, 5, and 6. Because the front rail 36 and rear rail 38 are substantially identical, only front rail 36 will be discussed. As shown most clearly on FIG. 6, the front and rear rails 36 and 38 have a generally U-shaped cross-section. The front rail 36 has a central U-shaped portion 94, a contiguous large or outwardly extending flange portion 96 and a contiguous small inwardly projecting flange portion 98. The large and small flange portions 96 and 98 form a mounting surface. The large and small flange portions are attached to the glass ceramic plate 10 by an adhesive 114. The large flange portion 96 has a plurality of detents or dimples 100 which are engageable with the countertop 62 and support the large flange portion a small distance above the surface of the countertop. These detents 100 minimize the area of thermal contact between the cooktop and the countertop and reduces the heat transfer from the front and rear rails to the countertop 62. Referring back to FIG. 4, the large flange portion 96 also has a series of trapezoidal-shaped recess 102 provided intermediate the detents 100. These recesses 102 increase the thermal conductivity path from the U-shaped portion to the detents 100 preventing the large flange from scorching the countertop 62. To further restrict the thermal path to the detents 100, slots 104 are provided on the large flange portion 96 intermediate the detents 100 and the U-shaped portion 94. The ends 106 and 108 of the front and rear rails 36 and 38 are cut at a 45° angles to mate with the side rails 44 and 48. Referring to FIG. 5, screw mounting holes 110 and 112 are provided in the front and rear rails to receive screws for attaching the primary cover 34 of the rough-in-box to the front and rear rails.

Figure 7:
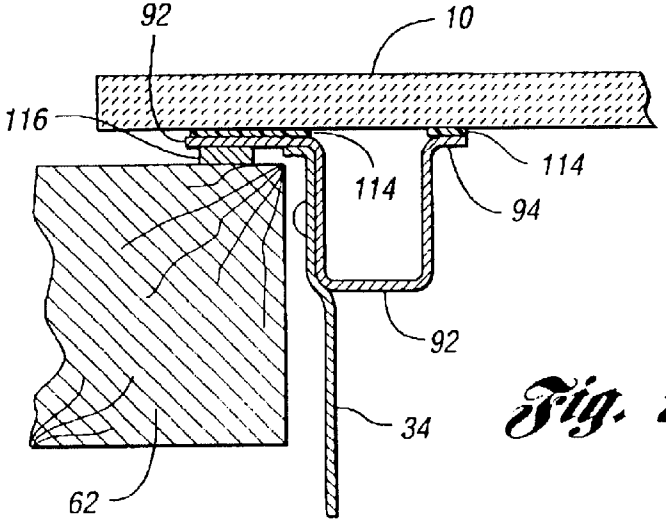
FIG. 7 is an end view of the front and rear rails having a thermal insulating pad.

As stated before the front and rear rails 36 and 38 are attached to the bottom surface of the glass ceramic plate 10 using an adhesive 114 as illustrated in FIG. 6. The large flange portion is contained within the periphery of its glass ceramic plate. The large flange portion 94 however overlaps the edge of the cutout 60 with only the detents 100 in physical contact with the countertop 62. In an alternate embodiment, shown on FIG. 7 insulating pads 116 may be used in place of the detents 100 to provide thermal insulation between the countertop 62 and the front and rear rails.

Figure 8:
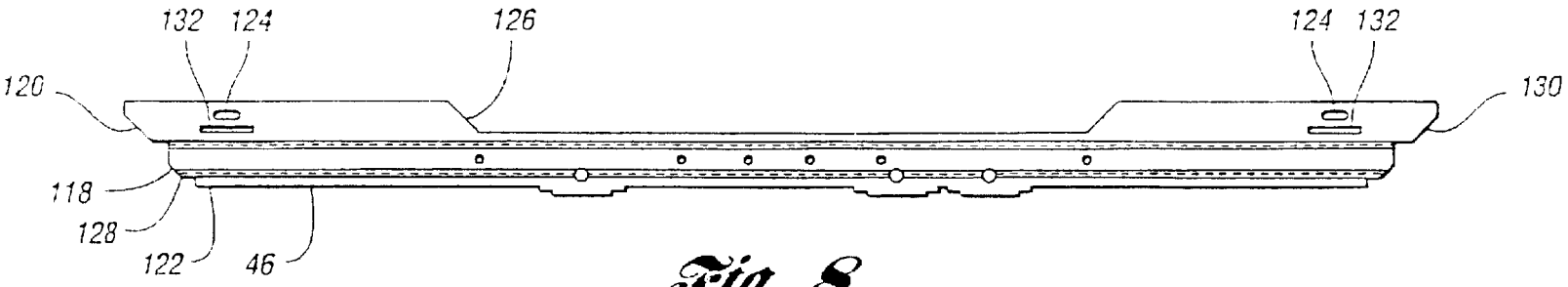
FIG. 8 is a top view of a side rail.
Figure 9:
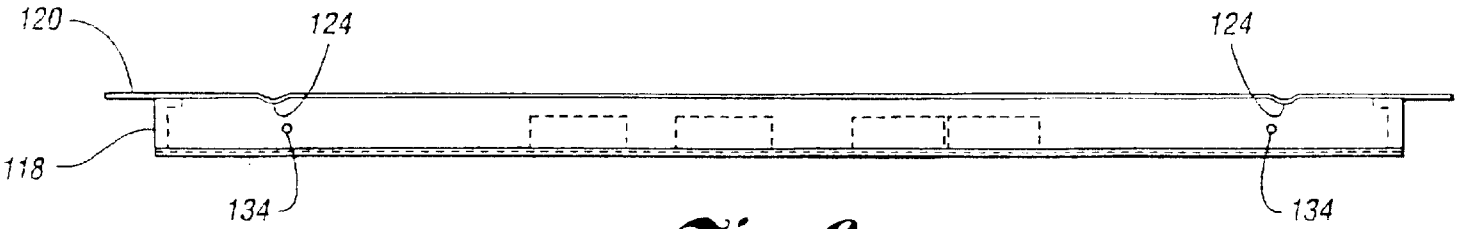
FIG. 9 is a side view of a side rail.

The details of the side rails 44 and 48 are shown on FIGS. 8 and 9. Like the front and rear rails, the side rails 44 and 48 have the same generally U-shaped cross-section corresponding to the cross-section of the front and rear rails as shown in FIG. 6. The side rails 44 and 48 have a U-shaped portion 118, an outwardly extending large flange portion 120 and an inwardly extending short flange portion 122 provided at the open end of the U-shaped portion 118. Like the front and side rails, the large flange portion of the side rails are contained within the periphery of the glass ceramic plate 10. The large flange portion 120 has at least one set of detents 124 corresponding to the detents 100 provided on the front and rear rails 36 and 38 respectively. The large flange portion 120 also has a trapezoidal recess 126 intermediate the two detents 124 as shown. The ends 128 and 130 of the side rails 44 and 48 are cut at a 45° angle to mate with the ends of the front and rear rails. As stated before, the ends of the side rails 44 and 48 are not attached to the ends of the front and rear rails 36 and 38 respectively. The side rails 44 and 48 further have screw mounting holes 128 for receiving screws or other types of fasteners attaching the end covers 42 and 46 of the rough-in-box to the side rails 44 and 48 respectively. The large flange portions 120 also have slots 132 intermediate the detents 124 and the U-shaped portion 118 to retard the heat transfer between the side rails and the countertop 62.

Figure 13:
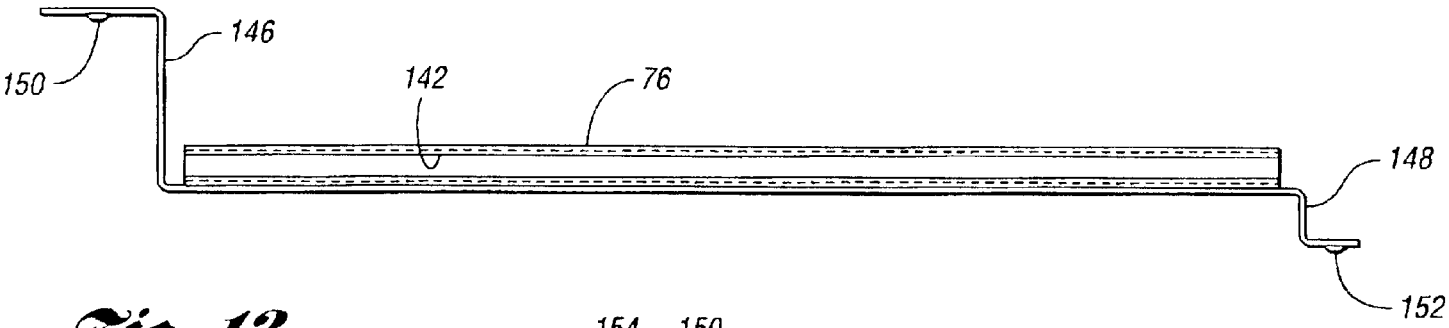
FIG. 13 is a side view of the short crossbar.
Figure 14:
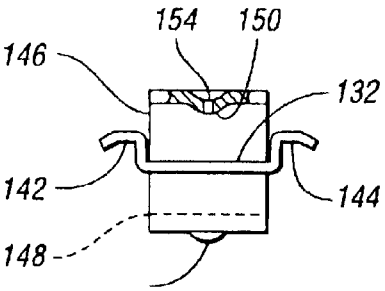
FIG. 14 is an end view of the short crossbar.
Figure 16:
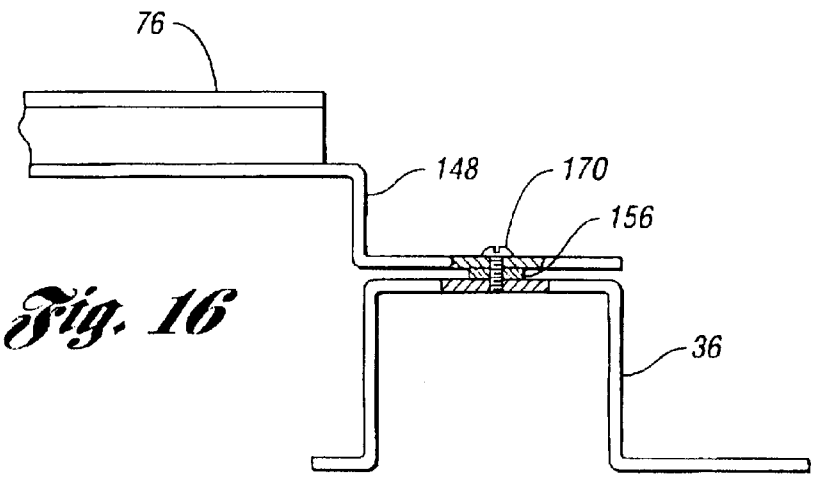
FIG. 16 is a partial view of an alternate embodiment of the short crossbar mounted to the rear rail.

The details of the short crossbar 76 are shown on FIGS. 13 and 14. The short crossbar 76 has a shallow U-shaped cross-section center portion 136 with short longitudinal flanges 142 and 144 along either side. A first mounting bracket 146 is provided at one end and a second mounting bracket 148 at the opposite end to mount the short crossbar to the rear rail 36 and the control box 24 respectively. The first and second brackets have detents, such as detents 150 and 152 as shown in FIG. 14 to minimize the thermal contact area between the short crossbar 76 and the rear rail 36 and the control box 24. A bolt or screw received through a hole 154 provided in the detents 150 and 152 respectively fasten the short crossbar 76 to the rear rail 36 and the control box 24 respectively. Alternately, the detents 150 and 152 may be replaced with a thermal insulating washer, such as washer 156 shown on FIG. 15 to thermally insulate the rear rail and control box from the short crossbar 76.

The details of the long crossbar 82 are shown on FIGS. 10 and 11. Like the short crossbar 76, the long crossbar 82 has a shallow U-shaped center portion 156 and two longitudinal flanges 158 and 160. Mounting brackets 162 and 164 are provided at the opposite ends of the long crossbar 82 to attach the long crossbar 82 to the front rail 36 and rear rail 38 respectively. As previously discussed, leaf springs 84, 86, 88 and 90 may be stamped directly from the long crossbar 82 as shown on FIG. 10 or may be separate leaf spring elements 92 as shown on FIG. 12. The mounting brackets 162 and 164 may have detents 166 and 168 corresponding to detents 150 and 152 of the short crossbar 76. The detents 166 and 168 will have holes through which a mounting screw such as mounting screw 170 can be used to attach the long crossbar 82 to the front and rear rails.

Figure 15:
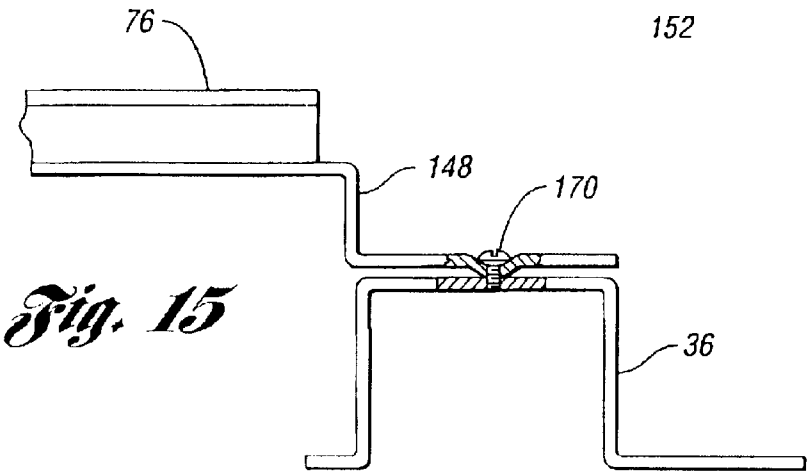
FIG. 15 is a partial view of the end of the short crossbar mounted to the rear rail.

As discussed relative to the short crossbar, the detents 166 and 168 may be replaced with thermal insulating washers such as insulating washer 156 shown in FIG. 15.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooktop receivable in a cutout provided in a countertop, the cooktop comprising:

a glass ceramic plate dimensioned to completely cover the cutout in the countertop, the glass ceramic plate having a top surface and a bottom surface;

front, rear, and two side rails independently and unconnectedly attached to the bottom surface of the glass ceramic plate in a pattern receivable in the cutout of the countertop, each of the front, rear and side rails having an outwardly extending flange contained within the perimeter of the glass ceramic plate, the outwardly extending flanges sized to overlap the edges of the cutout in the countertop;

at least one heating element supported adjacent to the bottom surface of the glass ceramic plate from at least one of the front, rear, and side rails;

a control box mounted to at least one of the front, rear and side rails adjacent the bottom surface of the glass ceramic plate, the control box containing electronic controls providing electrical power to the heating element; and a rough-in-box attached to the front, rear and side rails enclosing the bottom surface of the glass ceramic plate, the rough-in-box covering the at least one heating element and control box on the side opposite the glass ceramic plate.

2. The cooktop of claim 1 wherein each of the front, rear and side rails has a U-shaped portion having an open end facing the glass ceramic plate and the outwardly extending flange extends outwardly from the open end of the U-shaped portion adjacent to the bottom surface of the glass ceramic plate.

3. The cooktop of claim 2 wherein each of the first, second and side rails has at least one detent provided in the outwardly extending flange protruding in a direction away from the glass ceramic plate, the detents providing minimal area contact of the outwardly extending flanges and the countertop.

4. The cooktop of claim 3 wherein the outwardly extending flanges of the front, rear and side rails have at least two detents.

5. The cooktop of claim 4 wherein a recess is provided in each of the outwardly extending flanges intermediate the at least two detents.

6. The cooktop of claim 5 having a slot provided in the outwardly extending flanges of the front, rear and side rails intermediate the detent and the U-shaped portion, the slot increasing the length of the thermal path between the detent and the U-shaped portion.

7. The cooktop of claim 2 having at least one thermally insulating pad attached to each of the outwardly extending flanges of the front, rear and side rails, the insulating pads being attached to the outwardly extending flanges on the side opposite the glass ceramic plate.

8. The cooktop of claim 7 wherein said at least one thermally insulating pad is at least two thermally insulating pads.

9. The cooktop of claim 8 having a recess provided in each of the outwardly extending flanges of the first, second and side rails intermediate the at least two thermally insulating pads.

10. The cooktop of claim 8 having slots provided in each outwardly extending flange of the front, rear and side rails intermediate the thermally insulating pad and the U-shaped portions.

11. The cooktop of claim 1 wherein the rough-in-box comprises:

a primary U-shaped cover having one side fastened to one of the front, rear and side rails and the other side attached to the opposite front, rear and side rail, a first end cover attached to one of the remaining front, rear and side rails, a second end cover attached to another of the front, rear and side rails; and the first and second end covers enclosing the opposite ends of the U-shaped cover.

12. The cooktop of claim 2 wherein the at least one heating element comprises a plurality of heating elements, each attached to at least one of the front, rear and side rails.

13. The cooktop of claim 12 further including at least one crossbar to further support at least one of the heating elements, the crossbar connected at opposite ends to the front and rear rails.

14. The cooktop of claim 13 wherein the crossbar has at least one spring biasing the heating element against the glass ceramic plate.

15. The cooktop of claim 14 wherein the at least one spring is a stamped portion of the crossbar.

16. The cooktop of claim 14 wherein the at least one spring is a leaf spring attached to the crossbar.

17. The cooktop of claim 14 wherein the crossbar has a detent at each end at the point where the crossbar is connected to the front and rear rails respectively to reduce the area of thermal contact between the crossbar and the front and rear rails.

18. The cooktop of claim 14 having a thermal insulating pad attached to each end of the crossbar in the region where the crossbar contacts the front and rear rails respectively the thermal insulating pad reducing the heat transfer from the crossbar to the front and rear rail.

19. The cooktop of claim 18 wherein the thermal insulating pad is a thermal insulating washer permitting a fastener to pass therethrough.

20. A cooktop receivable in a cutout provided in a countertop, the cooktop comprising:

a glass ceramic plate sized to completely cover the cutout;

front, rear and side rails independently attached to the bottom surface of the glass ceramic plate, the front, rear and side rails each having a U-shaped portion and an outwardly extending flange, the outwardly extending flange being attached to the bottom surface of the glass ceramic plate and overlapping the edge of the cutout in the countertop;

a plurality of heating elements supported against the bottom surface of the glass ceramic plate from at least one of the front, rear and side rails;

a control box supported against the bottom surface of the glass ceramic plate from the front rail, the control box containing electronic controls selectively controlling electrical power to the plurality of heating elements;

at least one crossbar attached between selected ones of the front, rear and side rails to assist in the support of at least one heating element against the bottom surface of the glass ceramic plate; and a three-piece rough-in-box enclosing the plurality of heating elements and the control box supported against the bottom surface of the glass ceramic plate, the three-piece rough-in-box consisting of a U-shaped central cover having one end attached to the rear rail and the opposite end attached to the front rail, a first and second end cover attached to the side rails, the first and second end covers enclosing the opposite ends of the U-shaped control cover.

* * * * *

UNITED STATES PATENT AND TRADEMARK OFFICE

CERTIFICATE OF CORRECTION

PATENT NO. : 6,410,892 B1
DATED : June 25, 2002
INVENTOR(S) : Perschl et al.

It is certified that error appears in the above-identified patent and that said Letters Patent is hereby corrected as shown below:

Title page,
Item [12], change "Peschl et al." to -- Perschl et al. --.
Item [75], change "Franz Peschl" to -- Franz Perschl --.

Signed and Sealed this

Eighteenth Day of February, 2003

JAMES E. ROGAN
*Director of the United States Patent and Trademark Office*